US009868312B2

(12) United States Patent
Erho et al.

(10) Patent No.: US 9,868,312 B2
(45) Date of Patent: Jan. 16, 2018

(54) FORMING HIDDEN PATTERNS IN POROUS SUBSTRATES

(75) Inventors: Tomi Erho, Espoo (FI); Terho Kololuoma, Oulu (FI)

(73) Assignee: Teknologian Tutkimuskeskus VTT (FI)

( * ) Notice: Subject to any disclaimer, the term of this patent is extended or adjusted under 35 U.S.C. 154(b) by 302 days.

(21) Appl. No.: 14/123,103

(22) PCT Filed: Jun. 13, 2012

(86) PCT No.: PCT/FI2012/050591
§ 371 (c)(1),
(2), (4) Date: Feb. 13, 2014

(87) PCT Pub. No.: WO2012/172172
PCT Pub. Date: Dec. 20, 2012

(65) Prior Publication Data

US 2014/0161974 A1 Jun. 12, 2014

(30) Foreign Application Priority Data

Jun. 14, 2011 (FI) ..... 20115586

(51) Int. Cl.
*B41M 5/20* (2006.01)
*B41M 3/00* (2006.01)
(Continued)

(52) U.S. Cl.
CPC ..... *B41M 3/005* (2013.01); *B41M 1/18* (2013.01); *B41M 3/006* (2013.01); *B41M 3/14* (2013.01); *B41M 1/04* (2013.01); *B41M 1/10* (2013.01); *B41M 2205/36* (2013.01); *B42D 2035/34* (2013.01); *Y10T 428/24802* (2015.01); *Y10T 428/24934* (2015.01)

(58) Field of Classification Search
CPC ..... B41M 1/04; B41M 1/10; B42D 2035/34
See application file for complete search history.

(56) References Cited

U.S. PATENT DOCUMENTS 5,130,290 A * 7/1992 Tanimoto ..... B41M 3/001 503/200
2008/0213483 A1* 9/2008 Allison ..... B42D 15/0006 427/288
2009/0298191 A1 12/2009 Whitesides et al.

FOREIGN PATENT DOCUMENTS

EP 0864438 A1 9/1998
EP 1262329 A2 12/2002
(Continued)

OTHER PUBLICATIONS

Olkkonen, et al.; "Flexographically printed fluicid structures in paper"; Anal. Chem. ; Dec. 15, 2010; pp. 10246-10250; vol. 62, No. 24; American Chemical Society.
(Continued)

*Primary Examiner* — Xiao S Zhao

(57) ABSTRACT

The present invention concerns a method for manufacturing patterned porous substrates with hidden color patterns by forming hydrophobic patterns on a hydrophilic surface, wherein structural channels are formed as a pattern in a porous substrate using a hydrophobic printing solution lacking colorant, and wherein a colored area is applied on the rear surface of the porous substrate. Further, the present invention concerns said patterned porous substrate and a method for bringing said pattern into a visible state.

10 Claims, 5 Drawing Sheets

(51) Int. Cl.

| | |
|---|---|
| ***B41M 3/14*** | (2006.01) |
| ***B41M 1/18*** | (2006.01) |
| *B41M 1/04* | (2006.01) |
| *B41M 1/10* | (2006.01) |

(56) References Cited

FOREIGN PATENT DOCUMENTS

| | | | |
|---|---|---|---|
| EP | 1321307 | A2 | 6/2003 |
| EP | 2329958 | A1 | 6/2011 |
| JP | H0184263 | U | 6/1989 |
| JP | 2000034677 | A | 2/2000 |
| JP | 3082204 | U | 12/2001 |
| WO | WO 2010003188 | A1 | 1/2010 |
| WO | WO 2011073519 | A1 | 6/2011 |

OTHER PUBLICATIONS

Bruzewicz, et al.; "Low-cost printing of Poly(dimethylsiloxane) barriers to define microchannels in paper"; Anal. Chem; May 1, 2008; pp. 3387-3392; vol. 80, No. 9; American Chemical Society.
Abe, et al.; "Inkjet printed microfluidic multianalytic chemical sensing paper"; Anal. Chem; Aug. 13, 2008; pp. 6928-6934; vol. 80, No. 18; American Chemical Society.
Bruynzeel-sakura; Colour With Water; http://webshop.bruynzeel-sakura.com.
Daimaru Fujii Central, "When It Rains, Mysterious Umbrella Pattern Stand Out", Aug. 5, 2010, 3 pages, http://www.daimarufujii.co.jp/central-blog/zakka/3164/.

* cited by examiner

FORMING HIDDEN PATTERNS IN POROUS SUBSTRATES

BACKGROUND OF THE INVENTION

Field of the Invention

The present invention concerns a method of forming hidden color patterns, such as text or images, on porous substrates. Particularly, the invention concerns a method for manufacturing patterned porous substrates by forming hydrophobic patterns on a hydrophilic surface, the formed patterned porous substrates, and a method for bringing said pattern into a visible state.

Description of Related Art

In many porous substrates, such as nitrocellulose sheets, cellulose-based papers, and porous polymer sheets, liquids travel laterally along the substrate sheet. The flow is generally capillary. Such sheets and their liquid flow are exploited in many applications in the field of diagnostics, such as in biosensors and immunoassay-lateral-flows. In these applications, a strip has been used, in which the liquid travels laterally along the entire width of the strip, cut from a substrate sheet. In multi-analysis-tests, in which the sample liquid must be transported to several reaction/detection areas, it is advantageous for it to be possible to form the substrate sheet in such a way that the sample liquid travels in only specific parts of the sheet, i.e. structural layers guiding the liquid flow are formed in the sheet.

Such structural layers guiding the liquid flow can be manufactured in porous substrate sheets using many different methods (see e.g. US 2009/0298191 A1), such as the following methods, wherein:

- A substrate sheet is saturated with a photoresist, exposed to UV light through a photo-mask defining the liquid channels, and finally developed, when the photoresist is dissolved off the locations of the liquid channels. In this way, areas saturated with photoresist are created, which define the edges of the liquid channels.
- A hardening polymer, e.g., polydimethylsiloxane (PDMS), is spread on a stamp, the relief pattern of which defines the boundary areas of the liquid channels. After this, the stamp is pressed onto the substrate sheet, for example, for 20 seconds. Finally, the stamp is removed and the polymer is hardened.
- Liquids, which are either hydrophobic themselves, or which can convert the substrate sheet to become hydrophobic, can be applied on the substrate sheet according to a desired pattern, for example, using the following methods: spraying the liquid through a stencil, by silkscreen printing, by inkjet printing, or by using a plotter.
- The desired areas of the substrate are saturated to become hydrophobic by absorbing wax with the aid of heat.

In the publication by D. A. Bruzewicz, M. Reches, and G. M. Whitesides ('Low-cost printing of poly(dimethylsiloxane) barriers to define microchannels in paper', Anal. Chem., 2008, 80 (9), 3387-3392), barrier lines guiding the liquid flow are manufactured using a PDMS solution as an ink in the pen of a plotter.

With the exception of the photoresist-based method, the precision of the edges of the liquid-flow channels are a problem in the aforementioned methods according to the prior art. Because the liquid, which alters the substrate sheet in such a way as to guide a liquid flow, must be absorbed through the entire substrate sheet, it also spreads at the same time laterally and thus the edges of the liquid-flow channel do not become precise.

The publication K. Abe, K. Suzuki, and D. Citterio, 'Inkjet-printed microfluidic multianalyte chemical sensing paper', Anal. Chem., 80 (18), 6928-6934, 2008, discloses a method, in which the paper in first saturated with a 1.0 w-% polystyrene-toluene solution, dried, and the liquid channels are finally etched open by inkjet printing with toluene. The inkjet printing generally has to be repeated 10-30 times to achieve a sufficient etching depth, which makes it difficult to use the method in roller-to-roller manufacturing processes.

All of the aforementioned manufacturing methods according to the prior art are quite slow and thus difficult to use in industrial mass-manufacturing processes. In US 2009/0298191 A1, it is estimated that patterning a single 10×10 cm substrate sheet using a photoresist-based method takes about 8-10 minutes and with a method using a stamp about 2 minutes.

Crayola produces a product "Color Wonder", which is a paper coating, which reacts with "invisible" ink in such a way that color is formed. This color change has the disadvantage of being permanent. Further, the system is based on a specially developed paper coating, and is expensive to produce.

Bruynzeel-sakura produces a product "COLOUR WITH WATER" (e.g. http://webshop.bruynzeel-sakura.com), which consists of a white paper coating on a defined area, which becomes transparent upon addition of liquids such as water. The shape of the image in the system is visible prior to addition of water, as the form of the coating defines the area that becomes transparent.

SUMMARY OF THE INVENTION

An object of the present invention is to present a new cost-effective and rapid method for forming patterns on porous substrates, which permits the utilization of changes in the opacity of the substrate to make said patterns visible or invisible.

Particularly, it is an object of the present invention to present a new method for forming hidden images in porous substrates, such as paper or fabrics, by forming patterned channels guiding the liquid absorption and flow on said porous substrates.

These and other objects, together with the advantages thereof over known methods, are achieved by the present invention, as hereinafter described and claimed.

Thus, the present invention concerns a method of forming hidden images (or patterns) on porous substrates, such as paper, which hidden images are at least essentially invisible after their formation, but can be made visible through an induced change in the opacity of the pattern.

The pattern's visibility is enhanced by applying a colored area, preferably by printing, on the rear surface of the porous substrate. This colored area brings visual appeal on the product when the color is chosen to be compatible with the visible graphics or text printed on the top surface of the porous substrate.

More specifically, the method for manufacturing a patterned porous substrate of the present invention is characterized by what is stated in the characterizing part of Claim 1.

Considerable advantages are obtained by means of the invention. Thus, the present invention provides means for labeling products with hidden images that can be made visible and be hidden again, repeatedly. The images can be made visible using pure water as a marking liquid, providing a safe marking procedure causing no mess and no color transfer (e.g. to a table surface), as the colorants used in creating the patterns in the porous substrates will be present in the layers of the substrate, instead of being added during marking.

Another advantage of the invention is that, in terms of printing technology, it is compatible with existing printing machines and thus is highly suitable for mass production.

The invention also has the advantage that simple solutions, comprising a polymer and a solvent, or solutions substantially consisting of them, are considerably more economical than, for example, commercial photoresists, which are used in the methods according to the prior art.

Next, the invention will be described more closely with reference to the attached drawings and a detailed description.

BRIEF DESCRIPTION OF THE DRAWINGS

In the following, the embodiments and other advantages of the invention are examined in greater detail with reference to the accompanying drawings.

DETAILED DESCRIPTION OF THE PREFERRED EMBODIMENTS OF THE INVENTION

The present invention concerns a method of forming hidden color images on a porous substrate, such as paper, by combining fluid guiding channels/areas with printed color on the opposite side of the paper. The invention also concerns a patterned porous substrate formed using said channels and colored areas. The fluidic channels/areas are formed as a graphical shape by printing hydrophobic patterns. Upon addition of a sample solution on the substrate, the opacity of the substrate is decreased only in the areas surrounding the hydrophobic patterns, thus creating a visible image on the substrate. If a clear solvent is used as the sample solution, the image again disappears when the surface of the substrate is dried.

The invention is based on the idea that hydrophobic regions are printed to a certain shape on the substrate, preferably according to the method described in FI 20096334, i.e. by manufacturing structural liquid-guiding channels on the top surface of a porous substrate by flexo or gravure printing. This method has been found most advantageous for industrial production. These printed regions can be, for example, graphics or text, and are printed into the substrate, preferably into the top (front) side (side 1) of the substrate, such as the paper. The channels are suited for guiding a liquid solution to the desired areas of the surface.

The "channels" are intended to mean any areas of the substrate suitable for guiding liquid absorption. Thus, it is only essential for these areas that they are well defined, i.e. have clear edges to the areas of opposite hydrophobicity.

Figure 1:
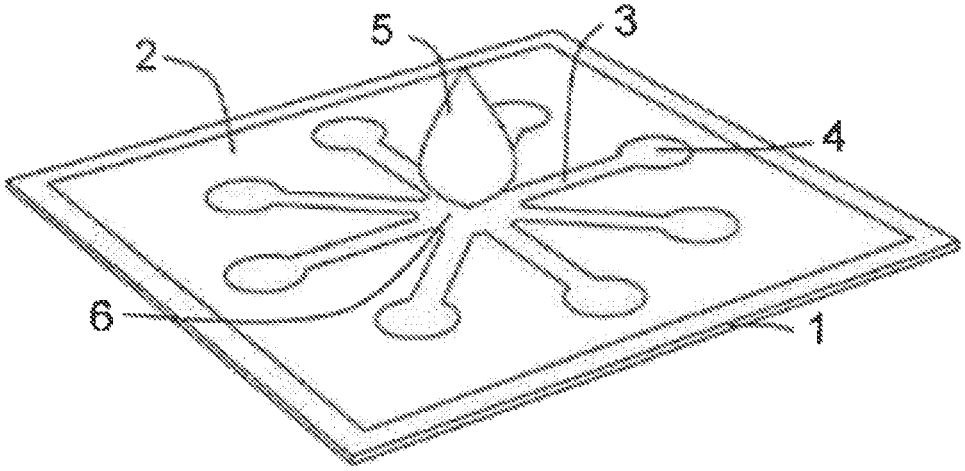
FIG. 1 presents the structure according to one embodiment of the invention.

FIG. 1 illustrates a structure according to an embodiment of the invention. A hydrophobic structural pattern 2 is formed on a substrate sheet 1, due to the effect of which a hydrophilic liquid can be absorbed into the substrate sheet only along the flow channels 3, reaction areas 4, and intersections 6 of the remaining hydrophilic surface areas, forming the pattern. A marking liquid 5 is applied to the surface of the substrate, thus causing the marking liquid 5 to absorb into the areas of the substrate surface having a corresponding hydrophobicity. The structural pattern 2 extends through the entire depth of the substrate sheet in the thickness direction. A unified or local layer is also printed on the rear surface of the substrate. This well covering layer typically extends over the entire width of the structural pattern 2 and could also prevent the marking liquid from coming through the substrate in its thickness direction. This layer is only partially visible through the porous substrate, before applying the marking liquid, when looking at the printed structural pattern 2 on the top side of the substrate sheet 1, since many of the substrates suitable for use in the present invention, particularly the lower grammage substrates (in case of paper substrates, especially those of <100 $g/m^2$), are slightly translucent. However, before applying the marking liquid, the formed patterns are not visible According to a particularly preferred embodiment of the invention, the unified or local layer printed on the rear surface is coloured, whereas the porous substrate is essentially opaque, at least when in a dry state. The pattern, in turn, is formed in the porous substrate, but will only become essentially or at least partially transparent when wetted. Thus, when such a substrate is wetted, the coloured rear surface will become visible through the transparent patterned areas.

For example a polymer, such as polystyrene, polymethylmethacrylate, cellulose acetate, alkyne ketene dimer or cross-linked polyvinylalcohol (PVA), or an organic compound of C≥20, but lacking the repeating units, such as paraffin wax or an alkyl ketene dimer (AKD), dissolved in a solvent, can be used as a printing solution, the task of which is to form the substrate sheet in such a way that the liquid flow is prevented in the area of the printed layers. Polystyrene is preferred, because it does not demand heat treatment and is completely bio-compatible. However, alkyne ketene dimer (AKD) is also particularly well suited to be used, especially with aqueous solvents, as a dispersion. AKD requires heating and time to function as hydrophobic barrier after the printing. This is easily accomplished, for example, if the printing equipment includes a dryer applying heat. Paraffin waxes, such as Aquacer products, also provide hydrophobic barriers, and are suitable for use in aqueous systems.

It is more preferable to use a printing solution made in an aqueous solution. However, the solvent can also be an organic hydrophobic solvent, for example, toluene, xylene, or a mixture of these, optionally also containing additives, but lacking colorant. The printing solution is preferably applied by flexo or gravure printing. Optionally, it can be applied by spraying the liquid through a stencil, by silk-screen printing, by offset or inkjet printing, or by using a plotter.

The amount of polymer in the printing solution can be, for example, 1-40 weight-%.

According to one embodiment, a printing solution with a relatively low polymer concentration is used, preferably of 2-10 weight-%, most suitably 3.5-7 weight-%. By using a low concentration, a greater structural depth is generally achieved, but the final concentration of polymer in the substrate will be correspondingly lower. This can be compensated for by increasing the number of print layers or by selection of an ink transfer roll with larger cell size, the latter option being particularly suitable when using flexo printing. According to one embodiment, at such a low polymer concentration there is at least two print layers.

According to a second embodiment, a relatively high polymer concentration of preferably 10-40 weight-%, most suitably 15-35 weight-%, is used. It has been observed in tests that, in printing solutions equipped with polymers with a particularly low molecular mass, such as polystyrene, the viscosity in this concentration range will still be sufficiently low for printing using the printing methods according to the invention and they still penetrate well into the pores of the substrate. In addition, due to the short chains, the properties of the printed structure can be, in many cases, better than when using polymer materials with a longer chain. In particular, such a material will probably form a denser barrier layer. Thus, as little as a single printing may be sufficient.

The molecular mass of the polymer used can be, for example, 2500-500 000. If the concentration of the polymer is greater than 10 weight-% of the printing solution, it is preferable to use a polymer with a molecular mass of 250 000 at most, particularly 100 000 at most. For example, in tests using a 20 weight-% concentration, it has been observed that bimodal polystyrene with a mean molecular mass of about 35 000 produces a very good print result, in terms of the liquid-guiding ability of the channels formed. However, it should be noted that the optimal molecular mass depends not only of the concentration, but also on other factors, such as the substrate material, the material that it is intended to place in the channel, and on the final application.

Figure 4A:
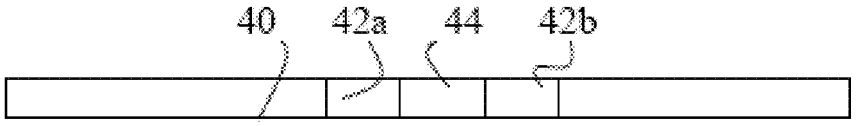
FIG. 4*a* shows a schematic side cross-section of a structure according to one embodiment of the invention.

FIG. 4*a* shows schematically the structure according to one embodiment of the invention. A first hydrophobic print zone 42*a* and a second hydrophobic print zone 42*b* are printed on the substrate 40, between which remains an unprinted hydrophilic zone, which may be used as a liquid zone 44. Hydrophilic liquid brought to the liquid zone 44 will remain in the zone in question, due to the print zones 42*a*, 42*b*.

There can be one or more print layers on top of each other. Typically, 1-3 print layers are used. By using several layers on top of each other, the polymer can be carried deeper into the substrate to reinforce the liquid-guiding effect of the print structures. A similar effect can also be achieved by increasing the pressure between the printing substrate and the printing cylinder.

The polymer concentration, the printing pressure, cell size of the printing roll and the number of printings are preferably selected in such a way that a structure zone extending to the full depth of the substrate is achieved.

Figure 4B:
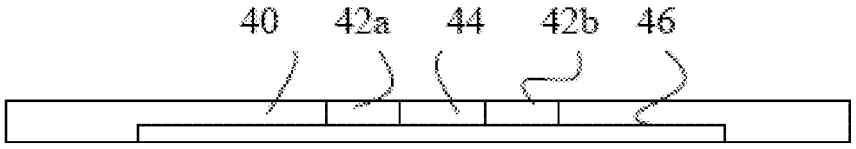
FIG. 4*b* shows a schematic side cross-section of a structure according to a second embodiment of the invention.

A unified or local base layer 46 is also printed on the rear surface of the substrate (side 2 of the substrate), as shown in FIG. 4*b*. This well covering layer typically extends over the entire width of the liquid zone 44 and may, optionally function as a barrier layer, whereby it prevents the liquid from coming through the substrate in its thickness direction. This base layer 46 can be, for example, of uniform color or sliding shades, and is not visible through the porous substrate, before applying the marking liquid, when looking at the printed pattern on side 1.

Thus, there can be a depth-direction barrier layer in the structure, in addition to the lateral barrier layers 42*a*, 42*b*. At the same time, the lateral liquid guiding effect improves and the need for print layers or pressure on the front surface of the substrate is reduced. There is also the advantage that, because the capillary volume decreases, the need for large liquid volumes substantially decreases. The movement of foreign substances into the sample zone from the base of the substrate (e.g., a table top) is also effectively prevented.

The base layer 46 on the rear surface of the substrate is preferably coloured to provide a coloured image after addition of the marking liquid. Optionally, the base layer 46 can merely have an increased opacity compared to other similar substrates lacking such a layer. This optional solution can be accomplished using a base layer 46 being white.

According to an alternative of the invention, the base layer 46 is applied using a coloured binder or glue, whereby the porous substrate can easily be glued onto another surface, such as a beverage coaster, a package or a label.

According to another alternative, the base layer 46 is applied using an ink containing one or more colorants, capable of being dissolved in a marking liquid, particularly an aqueous marking liquid, and especially capable of migrating with the marking liquid into the areas of the wetted porous substrate having a corresponding hydrophobicity. These colorants will, however, be present only in the base layer 46, not in the structural patterns (before the optional migration), nor in the marking liquid. Thus, the pattern is invisible before applying the marking liquid. Therefore, also according to this alternative, pure water can be used as the marking liquid, providing a safe marking procedure causing no mess.

Suitable colorants are any water soluble colorants, dye molecules, ions and pigments capable of migrating in the paper matrix.

According to the alternative of the migrating ink, the wetting of the porous substrate causes the colorants and/or other additives in the ink to migrate from into the desired areas of the porous substrate, hence causing coloration through the whole thickness of the substrate. During the paper drying, the colorants and/or other additives do not migrate back to the ink, hence causing an irreversible coloration of the substrate in said areas.

According to an embodiment, there are openings in the base layer 46 printed on the rear surface of the substrate, for feeding marking liquid to the liquid zone 44 and/or removing it from it, for example to a second substrate placed on top of the first substrate.

Any porous substrate whatsoever, in which a water-based liquid progresses laterally, can be used as the substrate, such as a paper or board substrate or a textile substrate. Preferably, the substrate is selected from fibrous substrates. Examples of suitable substrates are nitrocellulose sheets, cellulose-based papers, and porous polymer sheets. In particular, chromatography papers designed for this purpose can be used. Other examples are label paper, bag paper, filter paper (including cigarette filter paper) and book paper. According to another alternative, the substrate is formed of fabrics for clothing or other similar protective means intended for use in wet environments, such as swimwear, towels, rain coats or umbrellas.

Figure 2:
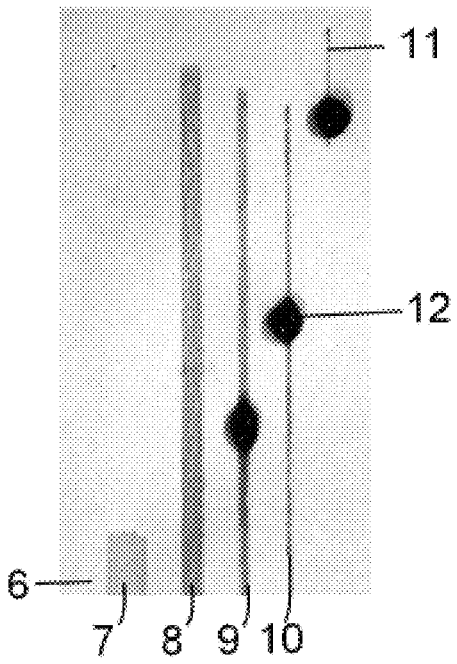
FIG. 2 shows an example of finished structure layers guiding the liquid flow.

FIG. 2 shows an example of liquid-flow guiding structural layers manufactured on paper (50 g/m$^2$) made from Eucalyptus fibres. Due to the effect of the hydrophobic structural layers 6, a hydrophilic liquid can only progress along the liquid channels 7-11. Channel 7 is 4-mm wide and channel 11 is 0.25-mm wide. In the figure, drops of water 12, which have spread by capillary action in the channels, and have been coloured with foodstuffs colours for illustrative purposes, are applied to the liquid channels. The structural layers 6 guiding the liquid flow are formed in the paper by flexo printing three print layers of a 5 weight-% polystyrene-xylene solution on top of each other. An RK Flexiproof 100 unit was used as the printing device. The printing speed was 60 m/min. The printing cylinder pressure was optimized to achieve the best result. If a single unified printing-solution layer was printed on the rear side of the paper, a single patterned layer on the front side would be sufficient to create liquid channels.

According to this example, a typical width of the flow channel 3 is 30 μm-5 mm, particularly 0.25 mm-4 mm.

Figure 3:
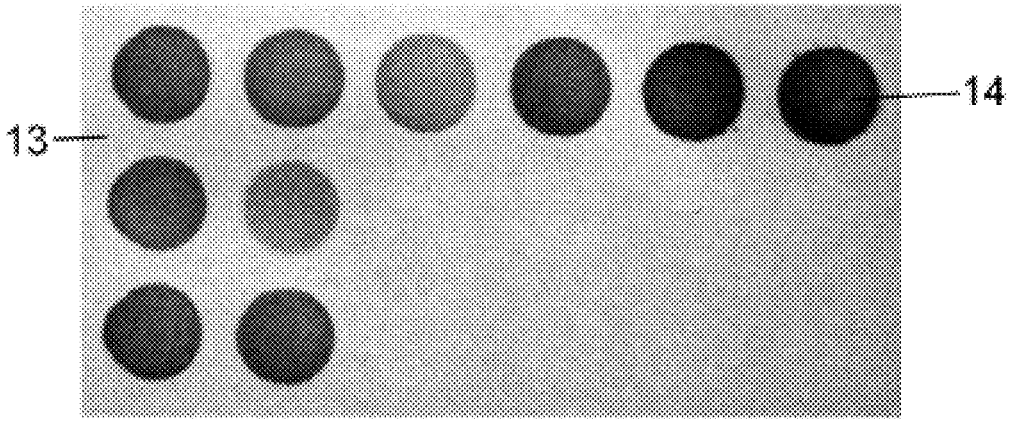
FIG. 3 presents an example of a micro-titre plate manufactured using the method according to the invention.

FIG. 3 shows an example of a micro-titre plate manufactured on paper (50 g/m$^2$) made from Eucalyptus. The paper contains 7-mm diameter 'liquid wells' 14, into each of which 20 μl of water is applied. A structural layer 13 guiding the liquid flow is formed around the liquid wells, in the same way as in the example of FIG. 2.

Figure 5:
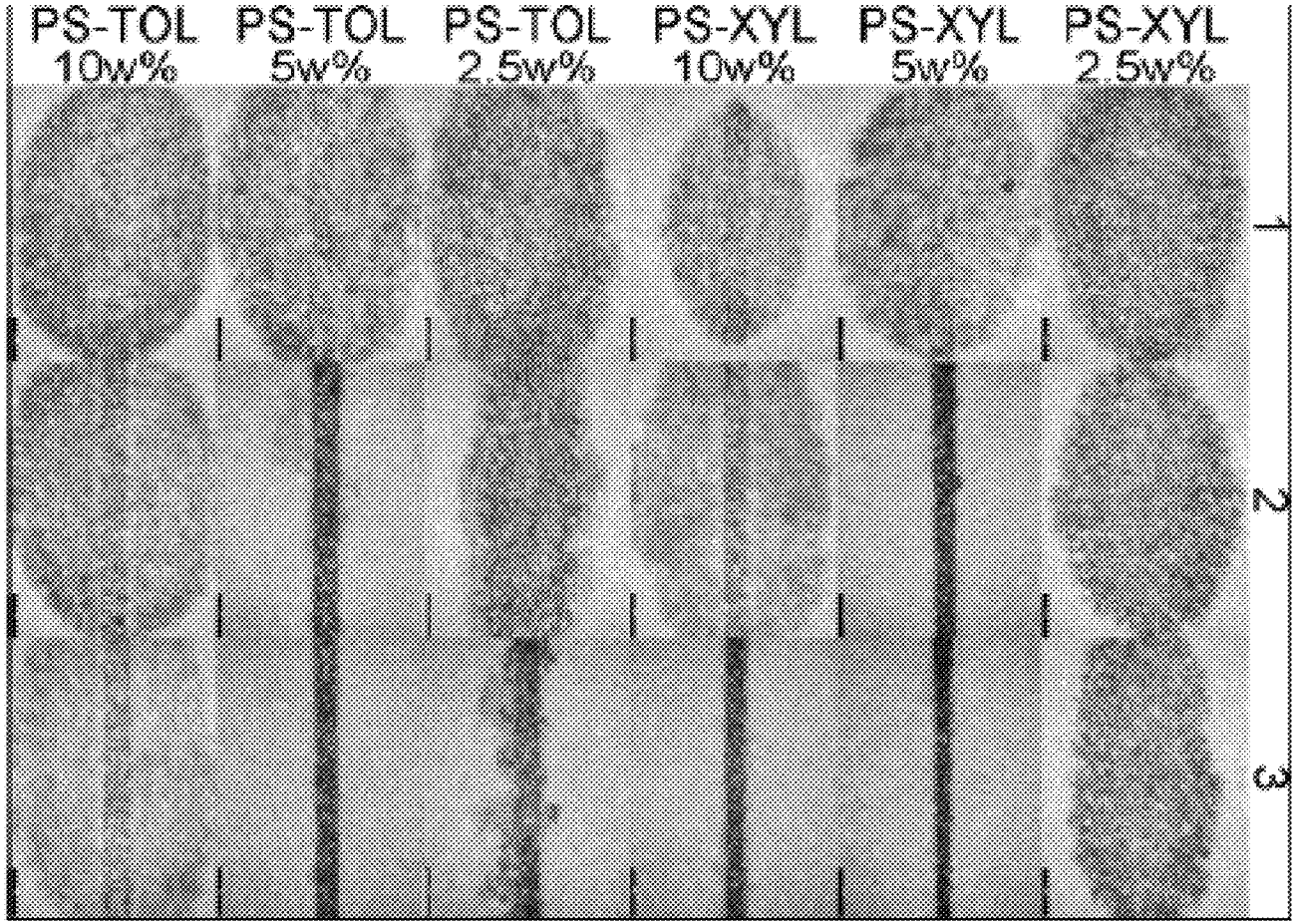
FIG. 5 illustrates the travel of liquid in liquid channels manufactured in different ways.

FIG. 5 shows the spreading of an aqueous solution in liquid channels made in different ways. Using both a polystyrene-xylene (PS-XYL) solution and a polystyrene-toluene (PS-TOL) solution, the best guiding effect on an aqueous solution (deionized water) was achieved using a polymer concentration of 5 weight-% and using at least two print layers. In all the cases in the figure the width of the liquid zone is 1 mm.

Figure 6:
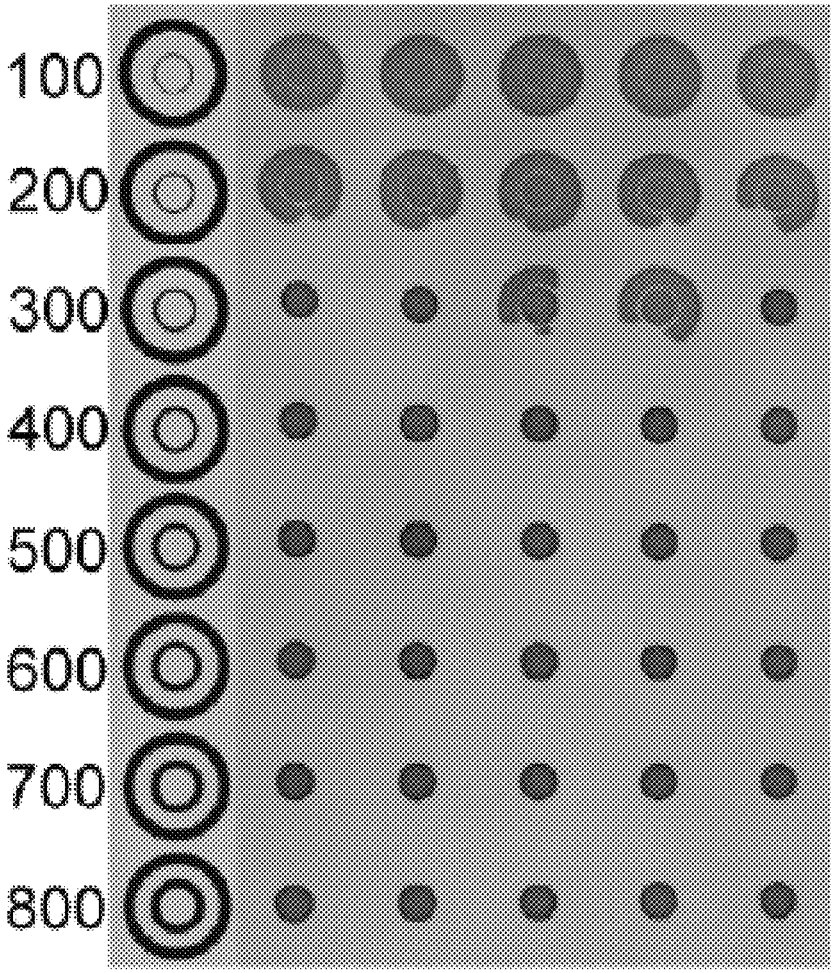
FIG. 6 illustrates the effect of the width of a produced structural zone on its ability to prevent a lateral liquid flow.

FIG. 6 shows the effect of the lateral width of the barrier zone on the capillary travel of a liquid. A 5-weight-% polystyrene-xylene solution was printed on chromatography paper as 100-800-μm rings (inner ring). Inside the ring, 5 μl of deionized water was applied. It was observed that the lateral flow to the barrier zone was entirely prevented using a structural width of about 400 μm.

By optimizing the printing process and the materials, it is possible to achieve patterns formed using channels having a width of even about 100 μm, which are nevertheless sufficiently tight.

According to one embodiment, in the same printing process, in which liquid-flow guiding structures are produced, biomolecules or other reagents for diagnostic tests are also printed on the substrate. Thus, entire analysis means can be easily manufactured, for example, using the roller-to-roller method.

The above mentioned marking solution is intended for making the formed pattern visible. Any substantially clear and colorant-free liquid can be used as the marking solution, such as water or an organic solvent, to obtain a reversibly visible pattern. However, it is preferred to use a hydrophilic solvent, most suitably being water, such as deionized or distilled water, particularly deionized water. Such a hydrophilic solution will cause wetting of the hydrophilic areas of the substrate surface, whereas a hydrophobic solution would cause wetting of the hydrophobic areas of the surface.

According to another alternative, a coloured hydrophilic marking solution is used, for example beer, cola, coffee, tea, juice, or another strongly colored soft drink or mixed drink, to obtain an irreversibly visible pattern.

Preferably, the marking solution is applied to the top surface of the porous substrate using pouring, brushing or spraying, or the surface of the substrate is allowed to become wet, for example via condensation water, leakage water, rain water or any natural supply of salty or fresh water, or any transferred or added water.

The condensation water can be, for example, water transferred to a beverage coaster or label, containing said patterned porous substrate on its surface, from a cold bottle or can of beverage.

The leakage water can be, for example, water leaking from a washing machine or a dish washing machine, whereby the patterned porous substrate has been added to a surface in close vicinity to any potential leakage sites.

The rain water can be, for example, water transferred to an umbrella or rain coat, containing said patterned porous substrate on its surface.

Further, the water (here the marking solution) can be transferred to swimwear or towels, containing said patterned porous substrate on their surface or within their fabric, for example as an authenticating or purely visual feature, or signifying that they have not yet dried.

The pattern formed using the invention is invisible on the substrate after printing (see FIG. 1). However, wetting the substrate with said marking solution will cause the solution to absorb into the areas of the substrate having the corresponding hydrophobicity, i.e. when using a hydrophilic marking solution, it will absorb into the hydrophilic areas surrounding the printed structures forming the pattern, whereby a change in the opacity of these areas will occur, which in turn will make the pattern visible. This is caused by the water or other clear or lightly colored liquids being introduced on the front surface of the substrate (side 1). Once the marking solution evaporates, leading to the drying of the substrate, the pattern will again disappear, i.e. become invisible.

As the liquid is absorbed into the areas of the porous substrate structure having a corresponding hydrophobicity, it diminishes the amount of light reflectance (optical surfaces) in these areas of the substrate matrix, such as the fibre+filler matrix of a fibrous substrate, and the print on the rear side (side 2) can be seen through the substrate in these areas. This makes earlier invisible patterns in the paper structure change into visible patterns.

Thus, the invention is suitable for use as a humidity indicator, and can be utilized for example in making moisture sensitive packaging or labeling. The invention could easily be used in multiple mass market applications, such as children's coloring books and beverage coasters. The invention could also potentially provide valuable marketing gimmicks or even anti-counterfeiting features into packaging or labeling of consumer packaged goods, for example by giving the user the information to add water/liquids on the paper sheet to reveal the hidden images. Therefore the market potential of the invention is in the order of hundreds of millions of units per day.

Another particularly suitable use is in fabrics, such as fabrics for clothing or other similar protective means, especially when intended for use in wet environments, such as swimwear, towels, rain coats or umbrellas, whereby the hidden labels or patterns have been formed on the surface of the fabric either before or after shaping the fabric into the piece of clothing.

The invention claimed is:

1. A method for manufacturing patterned porous substrates with hidden color patterns by forming hydrophobic patterns on a hydrophilic surface, said method comprising the steps of;

manufacturing structural channels in the form of a pattern in a porous substrate by flexo or gravure printing using a colorant-free hydrophobic printing solution on a front surface of the porous substrate, and applying a visible colored area on a rear surface of the porous substrate wherein the visible colored area is not visible through the porous substrate before applying a marking liquid, wherein the porous substrate is essentially opaque when in a dry state and wherein the porous substrate becomes at least partially transparent when wetted.

2. The method according to claim 1, further comprising the step of selecting the porous substrate from nitrocellulose sheets, cellulose-based papers, porous polymer sheets, and fabrics.

3. The method according to claim 1, further comprising the step of optimizing the penetration of the printing solution into the substrate sheet with the aid of the printing-cylinder pressure, the number of printings, cell size of the printing roll, the solvent of the printing solution, and/or the viscosity of the printing solution.

4. The method according to claim 1, further comprising the step of using a printing solution containing a polymer or an organic compound of C≥20, but lacking repeating units.

5. The method according to claim 1, further comprising the step of using a printing solution containing one or more hydrophobic organic solvents.

6. The method according to claim 1, further comprising the step of using a printing solution comprising polystyrene or alkyne ketene dimer as a dispersion as well as a solvent comprising toluene, xylene, or a mixture of these, the share of polystyrene in the printing solution being 2.5-40 weight-%, or an aqueous solvent.

7. The method according to claim 1, further comprising the step of applying the coloured area on the rear side of the substrate as an area of uniform colour or sliding shades.

8. The method according to claim 1, further comprising the step of applying the coloured area using flexo, gravure, offset, electrophotography or inkjet printing and a conventional printing ink.

9. The method according to claim 1, further comprising the step of applying the coloured area on the rear side of the porous substrate using a printing solution containing one or more colorants for providing a visible coloured area, optionally giving different areas of the rear side of the substrate different colours.

10. The method according to claim 1, wherein the hidden color patterns are capable of becoming visible through the porous substrate when the marking liquid is applied and becoming invisible when the marking liquid evaporates.

* * * * *